US006289992B1

(12) United States Patent
Monjure et al.

(10) Patent No.: US 6,289,992 B1
(45) Date of Patent: Sep. 18, 2001

(54) VARIABLE PRESSURE PUMP THROUGH NOZZLE

(75) Inventors: Noel A. Monjure, Houston; David D. Comeaux, Sugarland; Michael J. Scott, Houston, all of TX (US); Kenneth Sikes, Sr., Marrero, LA (US); Frank Ditta, Harvey, LA (US); Tim Gus Wolcott, New Orleans, LA (US); Larry M. Young, Covington, LA (US)

(73) Assignee: ABB Vetco Gray, Inc., Houston, TX (US)

( * ) Notice: Subject to any disclaimer, the term of this patent is extended or adjusted under 35 U.S.C. 154(b) by 0 days.

(21) Appl. No.: 09/356,717

(22) Filed: Jul. 20, 1999

Related U.S. Application Data

(63) Continuation-in-part of application No. 09/078,230, filed on May 13, 1998, now Pat. No. 5,927,405.

(60) Provisional application No. 60/049,539, filed on Jun. 13, 1997.

(51) Int. Cl.[7] ..... E21B 17/20; E21B 19/22; E21B 23/00

(52) U.S. Cl. ..... 166/384; 166/77.2; 166/242.2; 166/325; 166/385

(58) Field of Search ..... 166/242.1, 242.2, 166/384, 385, 381, 317, 50, 90.1, 97.5, 77.1–77.3, 277, 325, 222, 312; 137/540

(56) References Cited

U.S. PATENT DOCUMENTS 3,087,551 * 4/1963 Kerver ..... 166/224
4,754,810 7/1988 Bennett et al. .
4,844,166 7/1989 Going, III et al. .
4,972,904 11/1990 Godare .
4,997,042 * 3/1991 Jordan et al. ..... 166/379
5,018,583 5/1991 Williams .
5,172,765 12/1992 Sas-Jaworsky et al. .
5,236,036 8/1993 Ungemach et al. .
5,284,210 2/1994 Helms et al. .
5,348,096 9/1994 Williams .
5,511,617 4/1996 Snider et al. .
5,845,711 * 12/1998 Connell et al. ..... 166/384

* cited by examiner

*Primary Examiner*—Hoang Dang
(74) *Attorney, Agent, or Firm*—Bracewell & Patterson LLP; James E. Bradley

(57) ABSTRACT

An apparatus for insertion into a well to displace well fluid. A flexible hose is lowered into an annulus between strings of casing. A nozzle is affixed to the lower end of the hose. During insertion, the hose is pressurized and rigid to keep the hose from winding about the well. To keep the hose rigid, internal pressure is maintained in the hose. The nozzle is provided with a check valve that holds the internal pressure up to a selected amount. Once the hose is lowered to a desired depth, the operator increases the pressure sufficiently in the hose to open the check valve, thereby allowing heavy liquid to flow out. The heavy liquid displaces the lighter well production, which flows out of the outlet. After the heavy fluid has been dispensed, the internal pressure is reduced, causing the check valve to close. The check valve can also be opened during insertion, if desired.

15 Claims, 4 Drawing Sheets

VARIABLE PRESSURE PUMP THROUGH NOZZLE

CROSS-REFERENCE TO RELATED APPLICATIONS

This application is a continuation-in-part U.S. patent application Ser. No. 09/078,230, filed on May 13, 1998, in the U.S. Patent & Trademark Office, and issued as U.S. Pat. No. 5,927,405 on Jul. 27, 1999, which claims the benefit of U.S. Provisional Application No. 60/049,539, filed on Jun. 13, 1997.

TECHNICAL FIELD

This invention relates in general to well remediation systems and in particular to the process and components used for filling an annulus in a well with heavy liquid to control pressure build-up in an annulus surrounding leaking casing and/or cement.

BACKGROUND OF THE INVENTION

In wells drilled for petroleum production, a plurality of well casings of different sizes are suspended from a wellhead. A problem encountered in such wells is that of annular pressure control. In the annulus between different casing sizes, pressure may develop due to leaks between strings of casing. Previously, to control the pressure, a relatively heavy liquid is pumped into the annulus at the upper end of the well. The heavy liquid migrates slowly downward, displacing lighter liquid. This technique does not always work.

SUMMARY OF THE INVENTION

In this system, a flexible hose is lowered into an annulus between strings of casing. A nozzle is affixed to the lower end of the hose. The hose may be inserted several hundred feet into the well. During insertion, the hose must be pressurized and rigid to keep the hose from winding about the well. To keep the hose rigid, internal pressure is maintained in the hose. The nozzle is provided with a check valve that holds the internal pressure up to a selected amount. Once the hose is lowered to a desired depth, the operator increases the pressure sufficiently in the hose to open the check valve, thereby allowing heavy liquid to flow out. The heavy liquid displaces the lighter well production, which flows out of the outlet. After the heavy fluid has been dispensed, the internal pressure is reduced, causing the check valve to close. The check valve can also be opened during insertion, if desired. Although heavy fluid is discussed, it should be understood that other fluids including sealant or other Newtonian or non-Newtonian media may be used with the invention.

BEST MODE FOR CARRYING OUT THE INVENTION

Figure 1:
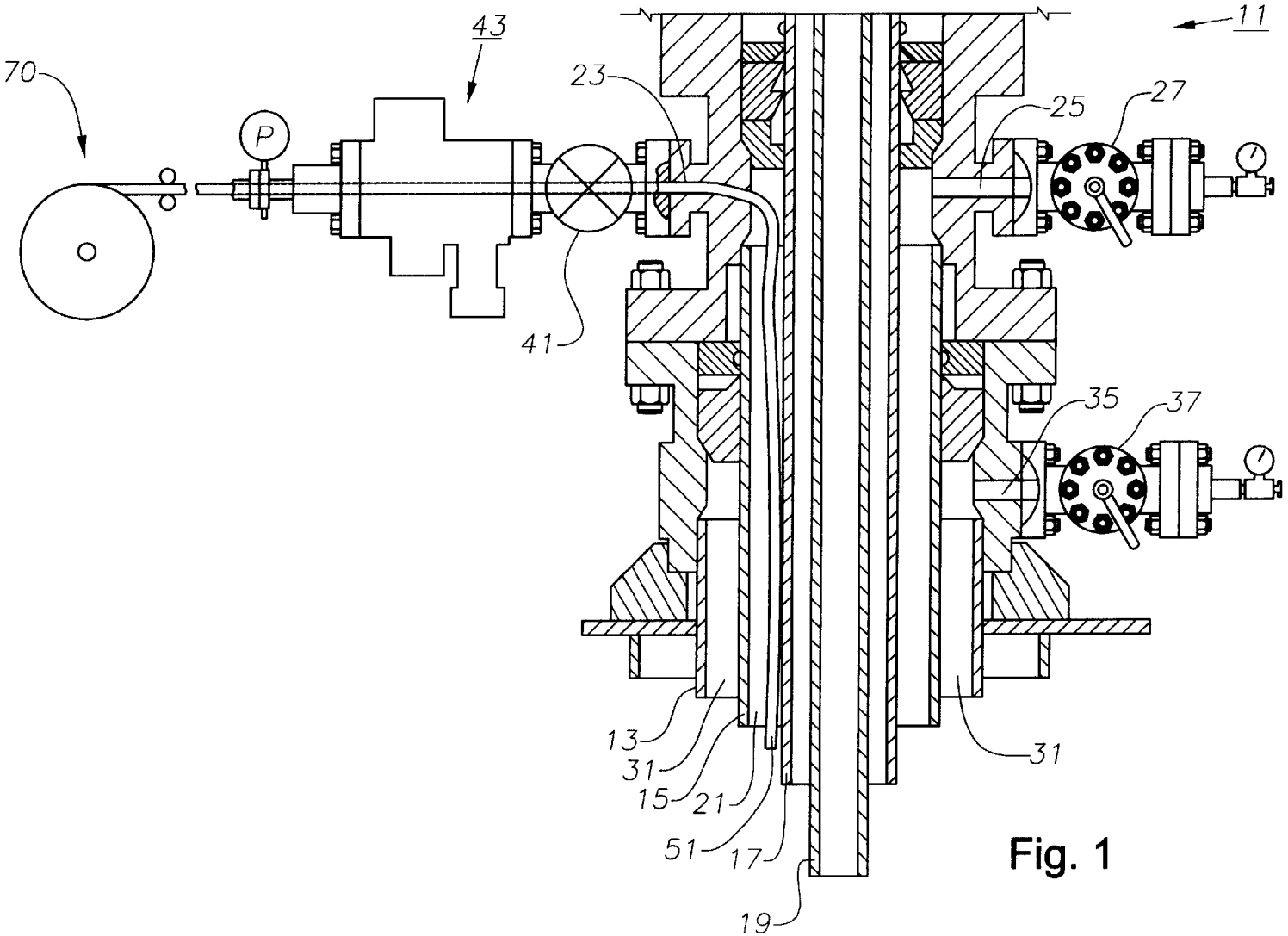
FIG. 1 is a sectional side view of a wellhead constructed in accordance with the invention.

Referring to FIG. 1, a wellhead 11 having multiple strings of casing 13, 15, 17, 19 suspended from it is shown. A longitudinal annulus extends between each pair of adjacent strings of casing. Each annulus has at least one access port at wellhead 11. For example, annulus 21 extends between casing strings 15 and 17, and has access ports 23, 25, while annulus 31 extends between casing strings 13 and 15, and has access port 35. Conventional valves 27 and 37 control flow through ports 25 and 35, respectively.

Figure 2:
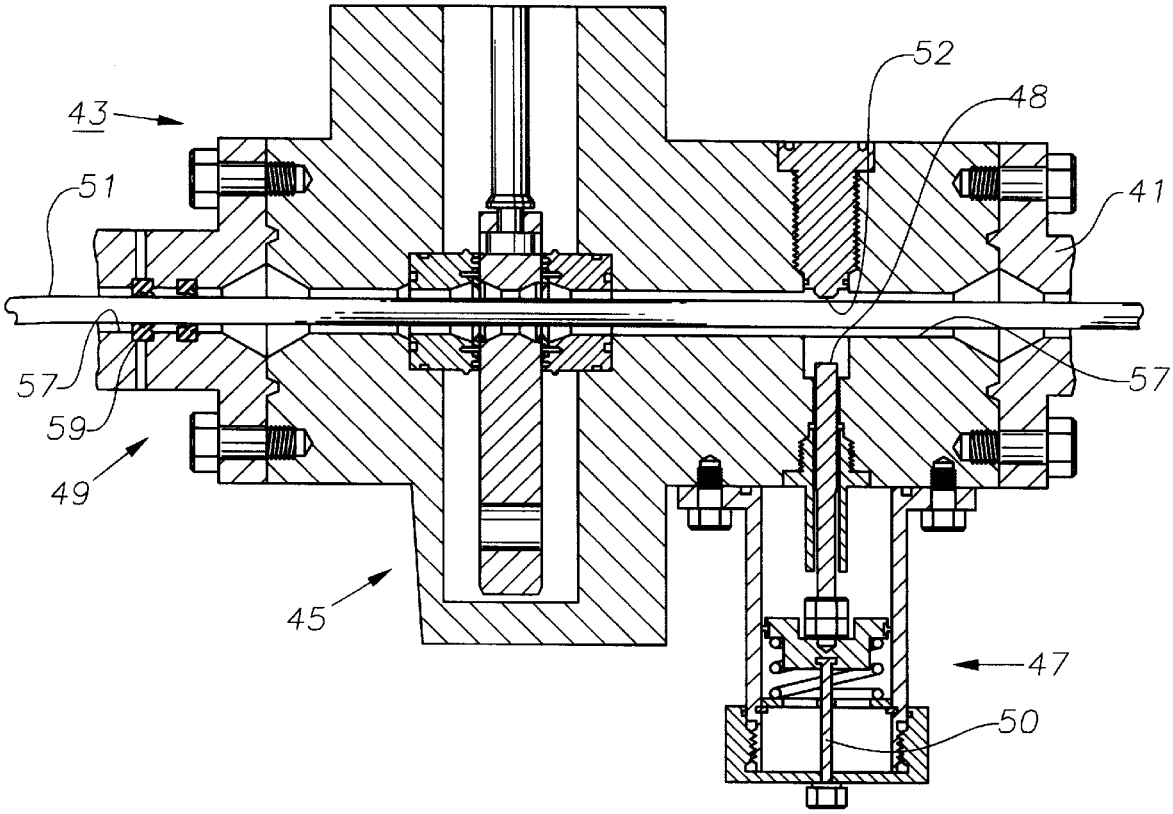
FIG. 2 is a sectional side view of a remediation valve and remediation hose capture assembly secured to the wellhead of FIG. 1.

A gate valve 41 is bolted to the outer surface of wellhead 11 and controls access to port 23. A stuffing box assembly 43 is secured to gate valve 41. As shown in FIG. 2, in this embodiment, stuffing box assembly 43 comprises a remediation valve 45, a pinning device 47, a packoff 49 and an axial passage 57. A flexible elastomeric hose 51 extends through passage 57. In the preferred embodiment, hose 51 comprises a strong polyester braid surrounded by two layers of plastic and has an outer diameter of about one inch. Hose 51 is coiled on a hose driver assembly 70 further upstream from stuffing box assembly 43.

Figure 3:
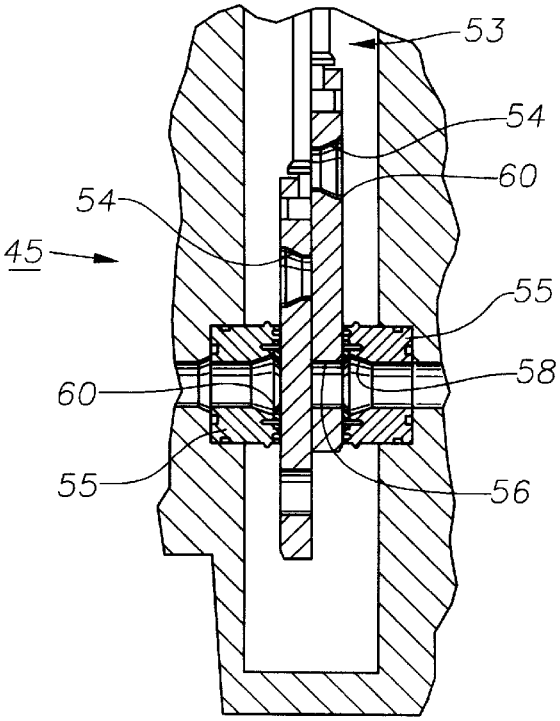
FIG. 3 is an enlarged, split sectional side view of a gate in the remediation valve of FIG. 2 showing a sealing position on the left side and a retrieval position on the right side.

As shown in FIG. 3, remediation valve 45 has a vertically slidable gate 53, and upstream and downstream seats 55 with axial holes 58 which register with passage 57. Gate 53 has two horizontal openings 54, 56 that are approximately the same diameter. Opening 54 and holes 58 have sharpened edges 60 made from tool steel for shearing hose 51 in an emergency. Gate 53 has three possible positions. In the running position (FIG. 2), opening 54 registers with holes 58. In the sealing or fail-safe position, a solid portion of gate 53 seals between seats 55 (left side of FIG. 3). Finally, in the retrieval position, opening 56 registers with holes 58 (right side of FIG. 3).

Returning to FIG. 2, pinning device 47 is located between remediation valve 45 and gate valve 41. Pinning device 47 has a cylindrical rod 48 on the end of a shaft 50. Rod 48 and shaft 50 are vertically moveable between an open position and a closed or pinning position (not shown) wherein hose 51 is clamped between rod 48 and a stop 52. Packoff 49 is a sealing system that is located on the upstream side of remediation valve 45. A conventional injection sealer 59 pumps grease around hose 51 to seal between hose 51 and passage 57.

Figure 4:
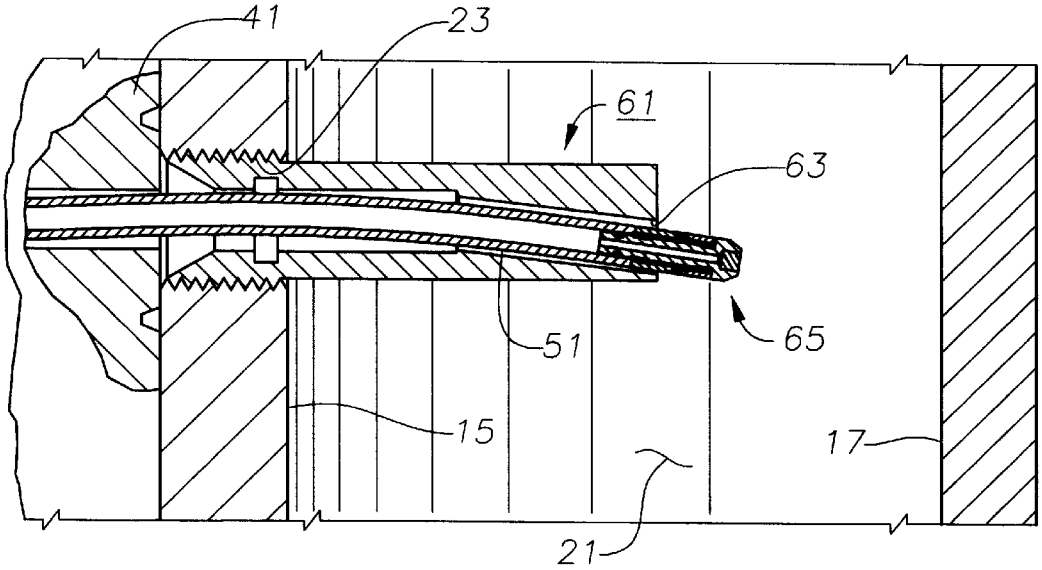
FIG. 4 is an enlarged sectional side view of a hose guide bushing in a port in the wellhead of FIG. 1.
Figure 5:
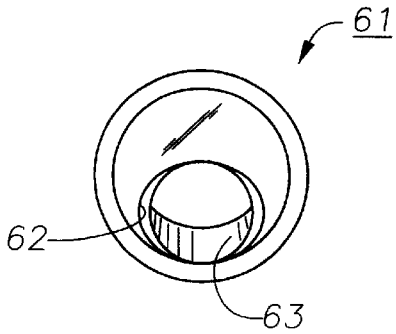
FIG. 5 is an end view of the hose guide bushing of FIG. 4.

Referring to FIGS. 4 and 5, a hose guide bushing 61 is threaded into and extends radially inward from access port 23 into wellhead 11. Hose guide bushing 61 has a passage 63 which communicates with passage 57 through gate valve 41. A radially inward portion of passage 63 is skewed downward at an obtuse angle relative to the outer portion of passage 63 into wellhead 11. A chamfer 62 is ground into passage 63 at the radially inward end of bushing 61. Chamfer 62 is ellpitical and has a greater horizontal width than vertical height. Hose 51 is inserted from the hose driver assembly 70, through passage 57 and gate valve 41, and into passage 63.

Figure 6:
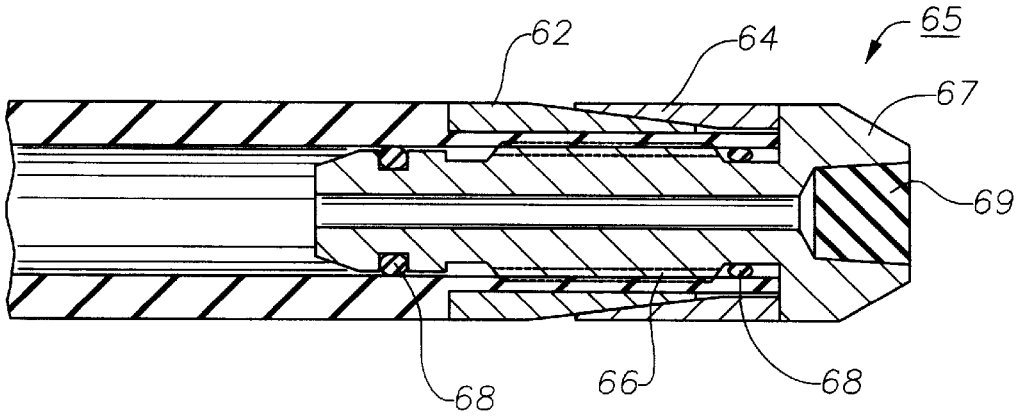
FIG. 6 is an enlarged sectional side view of a hose and nozzle.

As shown in FIG. 6, one end of hose 51 has a cylindrical tubing nose assembly 65 with self-tapping threads 66 fastened to one end. The diameter of hose 51 is reduced a small amount on the end where tubing nose 65 attaches. This reduction allows tubing nose 65 to have the same final outer diameter as hose 51. As tubing nose 65 is threaded into hose 51, ring 64*a* and wedges 64*b* crush hose 65 has a tapered tip 67 that is designed to assist the movement of hose 51 through the components of wellhead 11 and annulus 21. Tubing nose 65 also has a small plastic burst disc, plug, or cap 69 that opens by being blown out, rupturing under a selected pressure or opening by some other means. Cap 69 serves as a pressure retaining mechanism to hold pressure in hose 51 until a selected pressure is revealed.

In operation, if one of the strings of casing 13, 15, 17, or 19 begins to leak, a pressure build-up may occur in the annulus between the strings of casing. In this invention, pressure build-up is alleviated by pumping a heavy liquid into that annular space and displacing well fluid. If casing 17 is leaking, the heavy liquid is delivered to the annulus through hose 51, which is run through passages 57, 63 (FIGS. 2 and 4). Hose 51 is pressurized with the heavy liquid to sufficient pressure (approximately 100 psi) to make it substantially rigid. Hose 51 will be pushed into stuffing box assembly 43 and port 23 with gate 53 in the running position (FIG. 2). Although hose 51 is fairly rigid, hose guide bushing 61 steers hose 51 and tubing nose 65 slightly downward into annulus 21 (FIG. 4). Tip 67 of tubing nose 65 will glance off casing 17, and hose 51 is forced downward into annulus 21 (not shown). Chamfer 62 allows hose 51 some horizontal movement and prevents hose 51 from wedging between casing 17 and bushing 61. The hose driver assembly continues feeding hose 51 into annulus 21. Because of its rigidity, hose 51 may extend several hundred feet into annulus 21 without winding about the annulus (not shown). In an alternate embodiment, a fluid jet may be directed up to enhance the downward travel of the hose.

Once hose 51 and tubing nose 65 are at the correct depth, the pressure in hose 51 is sufficiently increased to burst cap 69, allowing the heavy fluid to flow out through tubing nose 65. The heavy liquid displaces the lighter well production fluid which flows out port 25 when valve 27 is opened (FIG. 1). Once the heavy liquid fills annulus 21, hose 51 may be removed and the valves are closed, or hose 51 may remain permanently in the well.

If packoff 49 is unable to prevent leakage around hose 51 due to high pressure in the well getting out of control or some other emergency occurs, pinning device 47 is used to pin hose 51 with rod 48 and stop 52. Gate 53 is then moved to the sealing position and hose 51 is sheared by edges 60 in a scissoring motion. It is important to have a clean cut so that hose 51 can be plugged with a fishing tool and retrieved later after the pressure is under control. After the pressure in the well is under control, gate 53 is moved to the retrieval position with hole 56 aligning with seat holes 58. A tool is run in through hole 57 to grip the cut end of hose 51. Pinning device 47 is then released and the remaining length of hose 51 is retrieved. In the final step, gate 53 is moved back to the running position so that the small piece of cut hose 51 still lodged in opening 54 may be removed with the tool. This operation could be performed on any annulus in wellhead 11.

Figure 7:
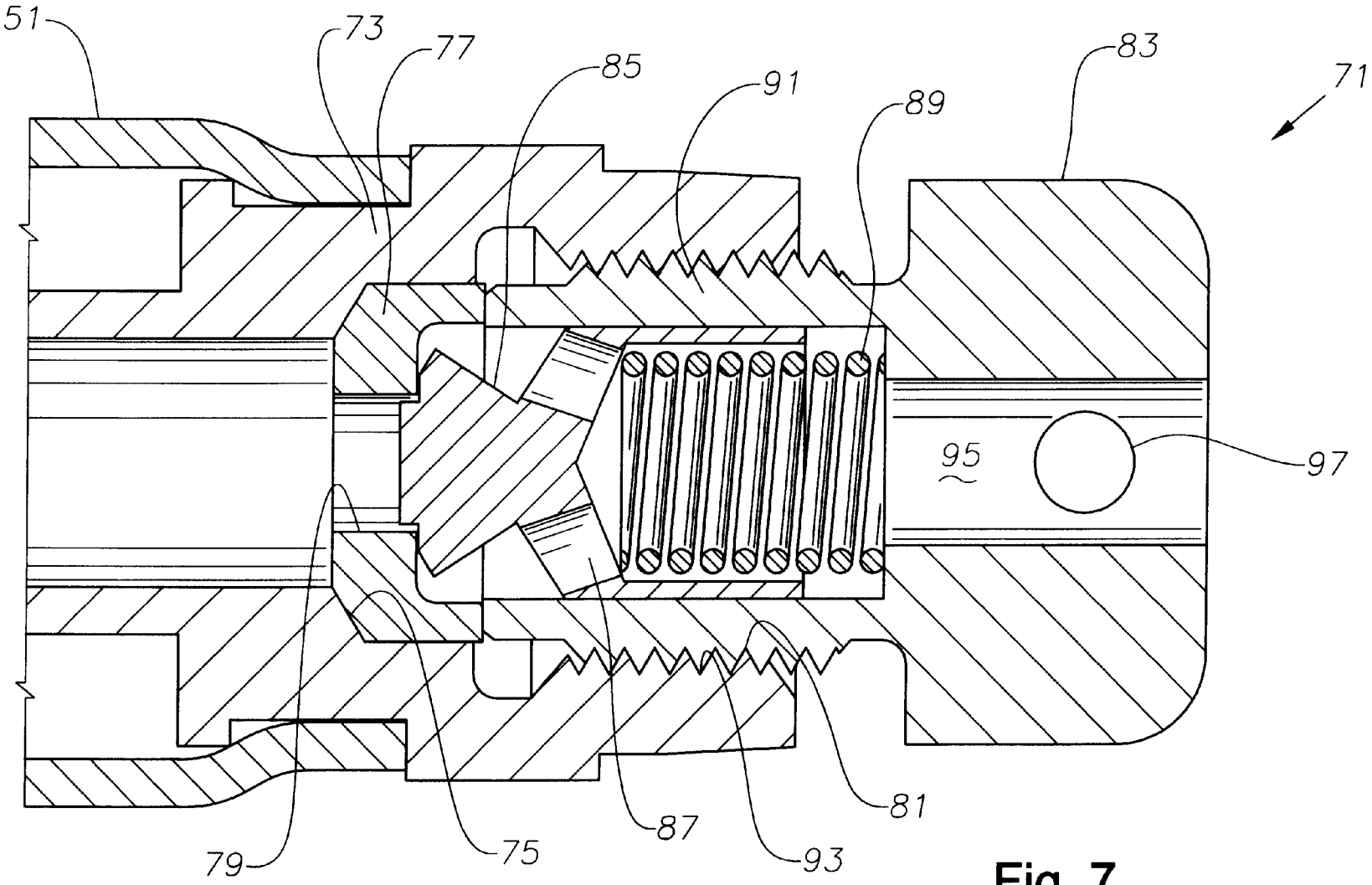
FIG. 7 is an enlarged sectional side view of an alternate embodiment of the hose and nozzle wherein the nozzle contains a check valve assembly.

Referring now to FIG. 7, an alternate embodiment tubing nose 71 is shown. Tubing nose 71 consists of a hose connector body 73. Preferably, hose connector body 73 is affixed to hose 51 by crimping a metallic sleeve provided on the terminal end of hose 51. Hose connector body 73 has a receptacle 75 that receives a valve seat 77 therein. Valve seat 77 has a centrally located orifice 79. Hose connector body 73 has internal threads 81 for threadably receiving contoured tip 83. Valve member 85 is biased against orifice 79 of receptacle 75. Valve member 85 has a head with a plurality of slots 87 that allow fluid to pass through and that engage spring 89. Spring 89 biases against an inner surface of contoured tip 83 and forces valve member 85 against orifice 79. Contoured tip 83 has a stem 91, which has external threads 93 for engaging internal threads 81 of hose connector body 73. Contoured tip 83 has a central orifice 95 and a plurality of radially extending passages 97.

In operation, during insertion hose 51 is pressurized to a level less than the amount that will open valve member 85. The operator may periodically increase the pressure sufficiently to open valve member 85 to clear ledges and the like. Once hose 51 and tubing nose 71 are at the correct depth, the pressure in hose 51 is sufficiently increased to lift valve member 85 off of valve seat 71, thereby allowing fluid to flow past valve member 85 and out through central orifice 95 and radial passage 97 of contoured tip 83. By providing a check valve arrangement within tubing nose 71, pressure can be maintained within hose 51 and can be bled off to zero pressure since valve member 85 seals tightly against valve seat 77 when pressure is reduced within hose 51. After the operation is completed, the internal pressure in the hose at the surface will be at ambient. Even if the well annular pressure increases, the internal pressure in the tubing at the surface will not increase.

The invention has significant advantages. After use, the tube may be safely left in the well without the possibility of increased annular pressure from entering the tubing. The provision of a check valve assembly within a tubing nose enables pressure within the hose to be bled off and reinstated repeatedly.

While the invention has been shown in only one of its forms, it should be apparent to those skilled in the art that it is not so limited, but is susceptible to various changes without departing from the scope of the invention.

What is claimed is:

1. An apparatus for insertion into a well to displace well fluid, said well having a wellhead, a lateral port, at least one string of casing supported in said wellhead and extending post said lateral port into said well, defining an annulus, said apparatus comprising:

a flexible tube adapted to be pushed through said lateral port;

a tubing nose with a check valve mechanism on a lower end of said tube which is capable of releasably holding a pressure to make said tube rigid, enabling said tube to be pushed down said annulus, said check valve mechanism being opened by increasing pressure in said tube to subsequently allow a remediation fluid to be pumped through said tube; and a pump connected to said tube for pressurizing said tube and delivering said remediation fluid.

2. The apparatus of claim 1, further comprising a housing adopted to be mounted to said lateral port and having a packoff for sealing around said tube as said tube is being pushed into said annulus.

3. The apparatus of claim 1, further comprising a pump operatively connected with said tube.

4. The apparatus of claim 1, wherein said valve mechanism prevents flow of fluid from said well into said tube.

5. An apparatus for insertion into a well to displace well fluid, said well having a wellhead, a lateral port, at least one string of casing supported in said wellhead and extending past said lateral port into said well, defining an annulus, said apparatus comprising:

a flexible tube adapted to be pushed through said lateral port;

a tubing nose with a check valve mechanism on a lower end of said tube which is capable of releasably holding a pressure to make said tube rigid, enabling said tube to be pushed down said annulus, said check valve mechanism being opened by increasing pressure in said tube to subsequently allow a remediation fluid to be pumped through said tube; and a pump connected to said tube for pressurizing said tube and delivering said remediation fluid;

wherein said tubing nose comprises:

a connector body for receiving said tube on a first end, said connector body having an inner chamber;

a tip affixed to a second end of said connector body, said tip having an orifice in communication with said inner chamber; and a valve member between said connector body and said orifice for selectively closing said orifice off from said inner chamber.

6. An apparatus for insertion into a well to displace well fluid, said well having a wellhead, a lateral port, at least one string of casing supported in said wellhead and extending past said lateral port into said well, defining an annulus, said apparatus comprising:

a flexible tube adapted to be pushed through said lateral port;

a tubing nose with a check valve mechanism on a lower end of said tube which is capable of releasably holding a pressure to make said tube rigid, enabling said tube to be pushed down said annulus, said check valve mechanism being opened by increasing pressure in said tube to subsequently allow a remediation fluid to be pumped through said tube; and a pump connected to said tube for pressurizing said tube and delivering said remediation fluid;

wherein said tubing nose comprises:

a connector body for receiving said hose on a first end, said connector body having an inner chamber;

a valve seat received within said connector body, said valve seat having a valve seat orifice;

a tip affixed to a second end of said connector body, said tip having an orifice in communication with said inner chamber;

a valve member between said connector body and said orifice for selectively sealingly engaging said valve seat orifice; and a spring engaging said tip and biasing said valve member against said valve seat orifice.

7. In a well having a wellhead having an axis, at least one lateral port which is substantially perpendicular to the axis, and at least one casing string supported in said wellhead and extending past said lateral port into the well defining a casing annulus surrounding said casing which is in communication with said lateral port, the improvement comprising:

a flexible elastomeric hose passing through said port into contact with a portion of said casing adjacent to said lateral port and redirected down said annulus to a selected depth; and a tubing nose on the hose, the tubing nose having a check valve mechanism therein that is capable of releasably holding a selected internal pressure in said hose to make said hose rigid, enabling said hose to be pushed down said annulus, said check valve mechanism being opened by increasing pressure in said hose beyond said selected internal pressure, enabling a remediation fluid to be discharged through said nose, said check valve mechanism closing by lowering said internal pressure below said selected internal pressure to prevent well fluid from entering said hose.

8. The apparatus according to claim 7 wherein said tubing nose comprises:

a connector body coupled to said lower end of said hose, said connector body having a passage therethrough for discharging remediation fluid;

a valve seat in said passage;

a valve member movably carried in said for selectively closing said orifice off from said inner chamber.

9. The apparatus according to claim 7 wherein said tubing nose comprises:

a connector body having a first end coupled to said hose, said connector body having an inner chamber;

a valve seat received within said connector body, said valve seat having a valve seat orifice with an upstream and a downstream side;

a tip affixed to a second end of said connector body, said tip having an orifice in communication with said inner chamber;

a movable valve member in said inner chamber for selectively sealingly engaging said downstream side of valve seat orifice; and a spring in said inner chamber biasing said valve member against said valve seat orifice.

10. The well of claim 7, further comprising a housing mounted to said lateral port and having a packoff for sealing around said hose as said hose is being pushed into said annulus.

11. The apparatus according to claim 7 further comprising:

a pump operatively engaged with said flexible hose for applying pressure to said hose and for delivering a remediation liquid through said hose while said closure mechanism is open to displace the well fluid in said casing annulus and prevent leakage.

12. A method of installing a conduit into a well having a wellhead with a longitudinal axis, at least one string of casing extending downward from the wellhead, an annulus surrounding the casing, and a lateral port in the wellhead which is substantially perpendicular to the axis and communicates with said annulus, comprising the steps of:

(a) passing a flexible hose having a closed lower end through said lateral port, causing said lower end to contact said casing across from said lateral port and deflect said hose downward into said annulus;

(b) pressurizing said hose to a first pressure to make said hose substantially rigid; and (c) continuing to push said hose downward in said annulus to a selected depth; then (d) opening said lower end of said hose when said lower end is at a desired depth;

(e) flowing fluid out of said lower end of said hose; then (f) closing said lower end of said hose and relieving pressure within said hose.

13. The method according to claim 12 wherein step (e) comprises pumping fluid from the surface through said hose and displacing well fluid from said annulus out an outlet port provided in said wellhead.

14. The method of claim 12 wherein step (d) comprises increasing the pressure in said hose to an amount greater than said first pressure to cause said lower end to open.

15. The method of claim 12 wherein step (f) comprises decreasing the pressure in said hose below said first pressure to cause closure of said lower end.

* * * * *

UNITED STATES PATENT AND TRADEMARK OFFICE

CERTIFICATE OF CORRECTION

PATENT NO. : 6,289,992 B1
DATED : September 18, 2001
INVENTOR(S) : Noel A. Monjure et al.

It is certified that error appears in the above-identified patent and that said Letters Patent is hereby corrected as shown below:

Column 3,
Line 3, after "hose" insert -- 51 into threads 66. A pair of O-rings 68 provide the necessary seal. Tubing nose --

Column 4,
Line 40, delete "post" and insert -- past --

Column 6,
Line 7, after "in said" insert -- check valve mechanism --

Signed and Sealed this

Twenty-fifth Day of June, 2002

*Attest:*

*Attesting Officer*

JAMES E. ROGAN
*Director of the United States Patent and Trademark Office*